US008986083B2

(12) United States Patent
Tanaka

(10) Patent No.: US 8,986,083 B2
(45) Date of Patent: Mar. 24, 2015

(54) COIN FEEDING DEVICE AND COIN HANDLING MACHINE

(75) Inventor: Mitsuo Tanaka, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 210 days.

(21) Appl. No.: 12/737,525

(22) PCT Filed: Jul. 23, 2008

(86) PCT No.: PCT/JP2008/063182

§ 371 (c)(1),
(2), (4) Date: Jan. 21, 2011

(87) PCT Pub. No.: WO2010/010614

PCT Pub. Date: Jan. 28, 2010

(65) Prior Publication Data

US 2011/0130083 A1 Jun. 2, 2011

(51) Int. Cl.

| | |
|---|---|
| ***G07D 1/00*** | (2006.01) |
| ***G07D 3/12*** | (2006.01) |
| ***G07D 9/00*** | (2006.01) |

(52) U.S. Cl.

CPC ..... *G07D 3/125* (2013.01); *G07D 9/008* (2013.01)

USPC ..... 453/49; 453/57

(58) Field of Classification Search

USPC ..... 194/302; 453/6, 10, 12, 13, 33–35, 49, 453/57

See application file for complete search history.

(56) References Cited

U.S. PATENT DOCUMENTS

| | | | | |
|---|---|---|---|---|
| 4,995,848 | A * | 2/1991 | Goh | 453/3 |
| 5,232,399 | A * | 8/1993 | Le Hong et al. | 453/57 |
| 6,080,057 | A | 6/2000 | Bell et al. | |
| 2002/0162724 | A1 | 11/2002 | Hino et al. | |
| 2003/0201146 | A1 * | 10/2003 | Abe et al. | 194/302 |
| 2009/0047888 | A1 * | 2/2009 | Nishida | 453/3 |

FOREIGN PATENT DOCUMENTS

| | | | | |
|---|---|---|---|---|
| EP | 0 731 428 | A2 | 9/1996 | |
| EP | 1927955 | A1 * | 6/2008 | G07D 9/00 |
| JP | 08-212407 | | 8/1996 | G07D 1/00 |
| JP | 08-212408 | | 8/1996 | G07D 1/00 |
| WO | WO 2007/034699 | A1 * | 3/2007 | G07D 9/00 |

OTHER PUBLICATIONS

EPO Search Report for Application No. 08791439.6-1229 / 2325810 PCT/JP2008063182 (dated Jun. 11, 2006—6 pages).

* cited by examiner

*Primary Examiner* — Jeffrey Shapiro

(74) *Attorney, Agent, or Firm* — Renner, Kenner, Greive, Bobak, Taylor & Weber

(57) ABSTRACT

A coin feeding device (70) includes: a rotary disc (72) that is inclined at a predetermined angle with respect to a vertical direction; a hopper member (74) configured to define a coin storage space (73) for storing coins between the hopper member (74) and a surface (72*b*) of the rotary disc (72); and a plurality of protruding members (78) disposed on the surface (72*b*) of the rotary disc (72). Coins in a lower area of the rotary disc (72) are transported by the respective protruding members (78) to an upper area of the rotary disc (72) along with a rotation of the rotary disc (72). A first guide member (80) is located nearer to a center of the rotary disc than the respective protruding members on the rotary disc (72), with a slight gap being defined between the first guide member and the surface (72*b*) of the rotary disc (72). The first guide member (80) is configured to guide, in the upper area of the rotary disc (72), the coins transported by the respective protruding members (78), to a coin transport mechanism (76).

14 Claims, 9 Drawing Sheets

COIN FEEDING DEVICE AND COIN HANDLING MACHINE

FIELD OF THE INVENTION

The present invention relates to a coin feeding device that stores coins put thereinto from outside and feeds the stored coins, and to a coin handling machine including the coin feeding device. In particular, the present invention relates to a coin feeding device capable of stably feeding normal coins one by one from a coin storage space, even when a rotary disc is rotated at a high speed so as to increase a processing speed of the coins, and to a coin handling machine including the coin feeding device.

BACKGROUND OF THE INVENTION

It has been conventionally known that a coin feeding device, which stores coins put thereinto from outside and feeds the stored coins, is installed inside a coin handling machine (see, JP8-212407A and JP8-212408A, for example). FIG. 12 is a front view showing the structure of a coin feeding device disclosed in JP8-212407A and JP8-212408A.

The coin feeding device 90 disclosed in JP8-212407A and JP8-212408A includes: a rotary disc 92 mounted on a rotary shaft 91, the rotary disc 92 being configured to be rotated by the rotary shaft 91 while being inclined at a predetermined angle with respect to the vertical direction; and a hopper member 93 configured to define a coin storage space 99 for storing coins between the hopper member 93 and a surface of the rotary disc 92. In the coin feeding device 90 shown in FIG. 12, the surface of the rotary disc 92 is provided with a plurality of protruding members 94. As shown in FIG. 12, the respective protruding members 94 are arranged at equal intervals therebetween on positions near to and along an edge of the rotary disc 92. The respective protruding members 94 catch coins on the surface of the rotary disc 92, so that the coins in a lower area of the rotary disc 92 are transported to an upper area of the rotary disc 92 along with the rotation of the rotary disc 92.

In the coin feeding device shown in FIG. 12, coins transported by the respective protruding members 94 to the upper area of the rotary disc 92 are sent to a coin passageway 96 by a coin transport means formed of, e.g., a transport belt 95. In this manner, the coins are fed out from the coin storage space 99. In the coin feeding device 90 disclosed in JP8-212407A and JP8-212408A, a dispense member 97 is mounted on a lower edge guide 96*a* of the coin passageway 96. The dispense member 97 is configured to take coins, which have been transported to the upper area of the rotary disc 92 by the protruding members 94, into the coin passageway 96. The dispense member 97 is opposed to the surface of the rotary disc 92 with a slight gap therebetween which does not allow passage of a coin. In addition, the dispense member 97 is provided with a groove 97*a* through which the protruding member 94 can pass.

DISCLOSURE OF THE INVENTION

However, the conventional coin feeding device 90 shown in FIG. 12 has a problem in that it is difficult to increase a processing speed of coins, i.e., an amount of coins to be fed out from the coin feeding device 90 within a certain period. That is to say, in order to increase a feeding amount of coins within a certain period in the coin feeding device 90 having the rotary disc 92, a rotary speed of the rotary disc 92 should be increased. However, in the coin feeding device 90 disclosed in JP8-212407A and JP8-212408A, for example, when the rotary speed of the rotary disc 92 is increased, the one protruding member 94 may catch a plurality of coins. In this case, when the one protruding member 94 together with the plurality of coins reaches the upper area of the rotary disc 92, there is a possibility that the coins might become stuck between the rotary disc 92 and the dispense member 97, or that the plurality of coins in a superposed state might be sent to the coin passageway 96 by the transport belt 95 of the coin transport means. Further, when the rotary speed of the rotary disc 92 is increased, there is a possibility that a foreign material other than a normal coin, specifically, a deformed coin or an object that is not a coin might be transported to the upper area of the rotary disc 92 by the protruding member 94. In this case, the foreign material may become stuck between the rotary disc 92 and the dispense member 97. Furthermore, when the rotary speed of the rotary disc 92 is increased, there occurs a problem in that a coin that has been brought up at a high speed along with the rotating rotary disc 92 might impinge on the protruding member 94 and rebound therefrom. Namely, the behavior of a coin becomes unstable. In addition, since the coin that has been transported by the protruding member 94 to the upper area of the rotary disc 92 is pushed and transported by a pin 95*a* of the transport belt 95 of the coin transport means, the behavior of a coin is not stable.

In the coin feeding device 90 disclosed in JP8-212407A and JP8-212408A, for example, when the rotary speed of the rotary disc 92 is increased, there occurs a problem in that it is difficult to stably feed coins from the coin storage space 99.

The present invention has been made in view of the above circumstances. The object of the present invention is to provide a coin feeding device capable of sending coins one by one from a rotary disc to a coin transport mechanism, even when the rotary disc is rotated at a high speed, so that normal coins can be stably fed one by one from a coin storage space, whereby a processing speed of coins can be increased, and to provide a coin handling machine including the coin feeding device.

A coin feeding device of the present invention is a coin feeding device comprising: a rotary disc that is inclined at a predetermined angle with respect to a vertical direction, the rotary disc being mounted on a rotary shaft by which the rotary disc is rotated while being inclined at the predetermined angle with respect to the vertical direction; a hopper member configured to define a coin storage space for storing coins between the hopper member and a surface of the rotary disc; a plurality of protruding members disposed on the surface of the rotary disc on a side of the coin storage space, the respective protruding members being located on positions near to an edge of the rotary disc, and the respective protruding members being configured to catch coins on the surface of the rotary disc, so as to transport the coins from a lower area of the rotary disc to an upper area of the rotary disc along with a rotation of the rotary disc; a coin transport mechanism disposed in the upper area of the rotary disc, the coin transport mechanism being configured to transport the coins, which have been transported by the respective protruding members to the upper area of the rotary disc, to an outside of the coin storage space; and a first guide member that is stationarily provided and is located nearer to a center of the rotary disc than the respective protruding members on the rotary disc, with a slight gap being defined between the first guide member and the surface of the rotary disc on the side of the coin storage space, the first guide member being configured to guide, in the upper area of the rotary disc, the coins having been transported by the respective protruding members, to the coin transport mechanism.

According to such a coin feeding device, the first guide member, which is configured to guide, in the upper area of the rotary disc, coins which have been transported by the respective protruding members to the coin transport mechanism, is stationarily provided on a position that is nearer to the center of the rotary disc than the respective protruding members of the rotary disc. Thus, even when the rotary disc is rotated at a high speed, there is no possibility that the coins transported in the upper area of the rotary disc by the respective protruding members might be sandwiched between the rotary disc and the first guide member, and therefore the coins can be stably sent one by one from the rotary disc to the coin transport mechanism. Thus, the normal coins can be stably fed one by one from the coin storage space to the outside thereof. As a result, a processing speed of coins of the coin feeding device can be increased as compared with that of the conventional money feeding device.

In the coin feeding device according to the present invention, it is preferable that the first guide member has a top surface portion configured to guide, in the upper area of the rotary disc, the coins, having been transported by the respective protruding members along with the rotation of the rotary disc, in a substantially horizontal direction so as to send the coins to the coin transport mechanism, whereby the coins having been transported by the respective protruding members to the upper area of the rotary disc are moved on the top surface portion of the first guide member in substantially the horizontal direction so as to reach the coin transport mechanism.

In addition, it is preferable that the first guide member has a shuffling portion configured to shuffle the coins in the coin storage space, the coin having been disengaged from the protruding member in the course of being transported by the protruding member from the lower area of the rotary disc to the upper area thereof.

In addition, it is preferable that the first guide member has a guide wall portion configured to guide upward the coins, which have been transported by the respective protruding members from the lower area of the rotary disc, along the surface of the rotary disc at a position that is substantially the same level as the center of the rotary disc.

It is preferable that the coin feeding device according to the present invention further comprises a second guide member that is stationarily provided, and is located radially outward from the rotary disc on a position that is upper than the center of the rotary disc, the second guide member being configured to guide, when two or more coins in a superposed state are transported by the one protruding member from the lower area of the rotary disc, the coin(s) lying upon the other coin(s) on the rotary disc radially outward from the rotary disc by the centrifugal force of the rotary disc.

According to such a coin feeding device, when two or more coins in a superposed state are transported by the one protruding member from the lower area of the rotary disc, the second guide member guides the coin lying upon the other coin(s) on the rotary disc radially outward from the rotary disc by the centrifugal force of the rotary disc. The coin, which has been guided radially outward from the rotary disc, is disengaged from the protruding member so as to be returned to the lower area of the rotary disc by its own weight. Since such a second guide member is provided, when two or more coins in a superposed state are transported by the one protruding member from the lower area of the rotary disc, the coin(s) lying upon the other coin(s) on the rotary disc can be returned to the lower area of the rotary disc by its (their) own weight(s). Thus, a processing speed of coins of the coin feeding device can be increased as compared with that of the conventional money feeding device. Even when two or more coins in a superposed state are transported by the one protruding member from the lower area of the rotary disc, the coin(s) lying upon the other coin(s) on the rotary disc can be returned to the lower area of the rotary disc by the second guide member.

When three or more coins in a superposed state are transported by the one protruding member from the lower area of the rotary disc, the second guide member may be configured to guide the coin(s) lying upon the other two superposed coins on the rotary disc radially outward from the rotary disc by the centrifugal force of the rotary disc.

It is preferable that the coin feeding device according to the present invention further comprises a lever member that is disposed in the vicinity of the edge of the rotary disc, the lever member having a shaft that is disposed radially outward from the rotary disc, the lever member being swingable about the shaft along the surface of the rotary disc on the side of the coin storage space, and the lever member being located such that a gap through which one normal coin can pass is defined between the lever member and the surface of the rotary disc on the side of the coin storage space.

According to such a coin feeding device, since the lever member is disposed in the vicinity of the edge of the rotary disc, with a gap through which one normal coin can pass being defined between the lever member and the surface of the rotary disc on the side of the coin storage space, two or more coins in a superposed state can be restrained from being sent from the lower area of the rotary disc to the upper area thereof. Thus, a processing speed of coins of the coin feeding device can be increased as compared with that of the conventional money feeding device. Even when two or more coins in a superposed state are transported by the one protruding member from the lower area of the rotary disc, the coin(s) lying upon the other coin on the rotary disc can be returned to the lower area of the rotary disc by the lever member.

It is preferable that the lever member is structured such that the distance between the lever member and the surface of the rotary disc on the side of the coin storage space is gradually increased along the coin transport direction along the edge of the rotary disc.

It is preferable that in the vicinity of the location of the lever member, the first guide member has a projecting portion that projects away from the surface of the rotary disc, whereby a coin, which has been disengaged from the protruding member by the lever member, falls down along the projecting portion of the first guide member to the lower area of the rotary disc.

It is preferable that the coin feeding device according to the present invention further comprises a third guide member that is stationarily provided, and is located in the upper area of the rotary disc, the third guide member being disposed such that a gap through which one normal coin can pass is defined between the third guide member and the surface of the rotary disc on the side of the coin storage space.

According to such a coin feeding device, since the third member is provided such that a gap through which one normal coin can pass is defined between the third guide member and the surface of the rotary disc on the side of the coin storage space, two or more coins in a superposed state can be restrained from being sent to the coin transport mechanism. Thus, a processing speed of coins of the coin feeding device can be increased as compared with that of the conventional money feeding device. Even when two or more coins in a superposed state are transported by the one protruding member from the lower area of the rotary disc, the coin(s) lying upon the other coin on the rotary disc can be returned to the lower area of the rotary disc by the third guide member.

It is preferable that the third guide member is structured such that the distance between the third guide member and the surface of the rotary disc on the side of the coin storage space is gradually increased along the coin transport direction along the edge of the rotary disc.

It is preferable that the third guide member has an inclined portion that is inclined such that, when two or more coins in a superposed state are transported by the one protruding member to the third guide member, the coin(s) lying upon the other coin(s) on the rotary disc is (are) separated from the rotary disc.

In the coin feeding device according to the present invention, it is preferable that the surface of the rotary disc is provided with a shuffling protrusion configured to shuffle the coins in the coin storage space, when the rotary disc is rotated.

It is preferable that the coin feeding device according to the present invention further comprises a detecting unit configured to detect whether an object exists in the coin storage space or not; a drive unit configured to openably and closably drive the hopper member; and a control unit configured to control the drive unit, such that, when the detecting unit detects that an object remains in the coin storage space after the operation for feeding coins in the coin storage space to the outside of the coin storage space has been finished, the drive unit opens the hopper member so that the object remaining in the coin storage space falls down from the coin storage space.

A coin handling machine according to the present invention is a coin handling machine comprising: a housing; a coin inlet through which coin(s) is (are) put from outside into the housing; the aforementioned coin feeding device to which the coin put into the coin inlet is sent; a recognition unit configured to recognize the coin transported by the coin transport mechanism of the coin feeding device; and a storing unit configured to store the coin transported by the coin transport mechanism.

DETAILED DESCRIPTION OF THE INVENTION

Figure 1:
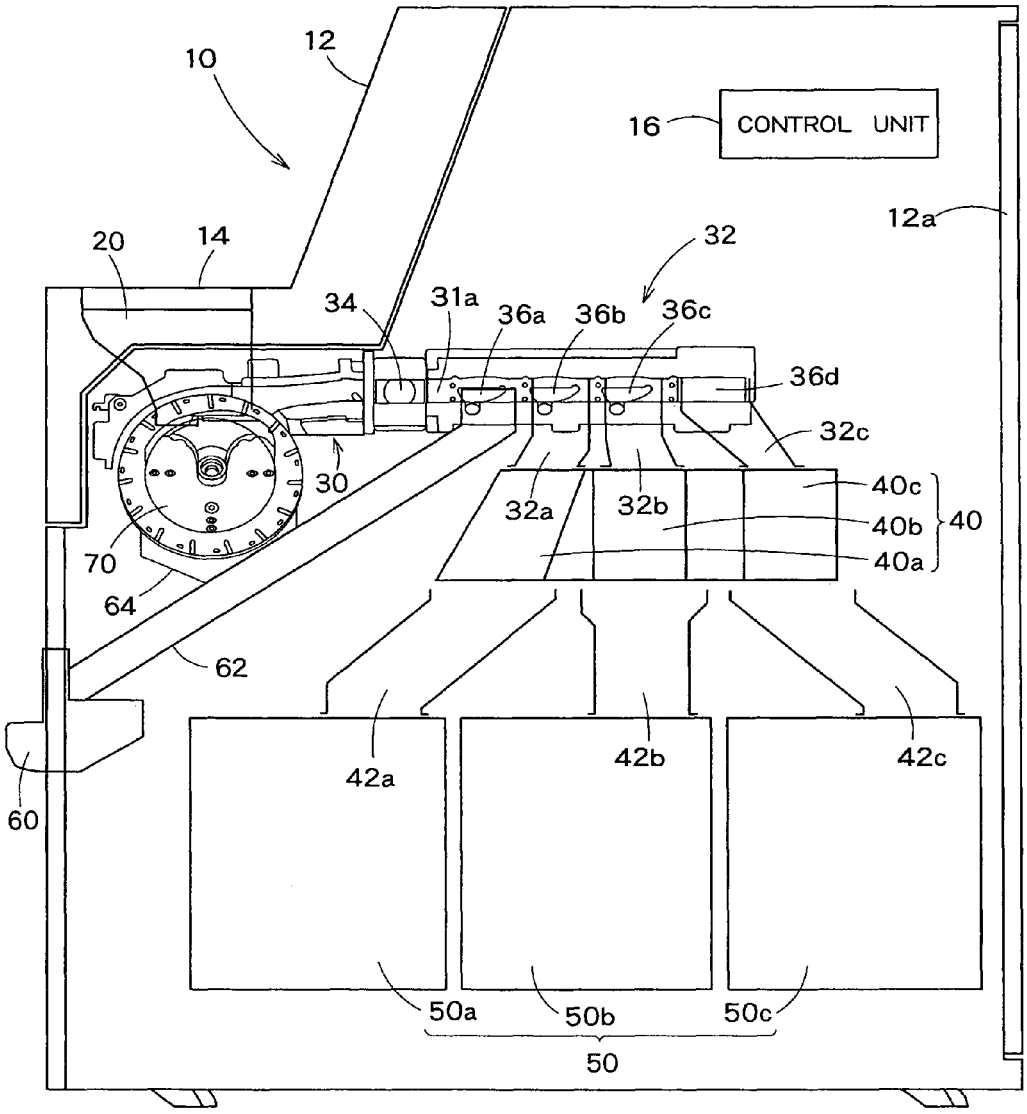
FIG. 1 is a structural view schematically showing an inner structure of a coin handling machine in one embodiment according to the present invention.
Figure 2:
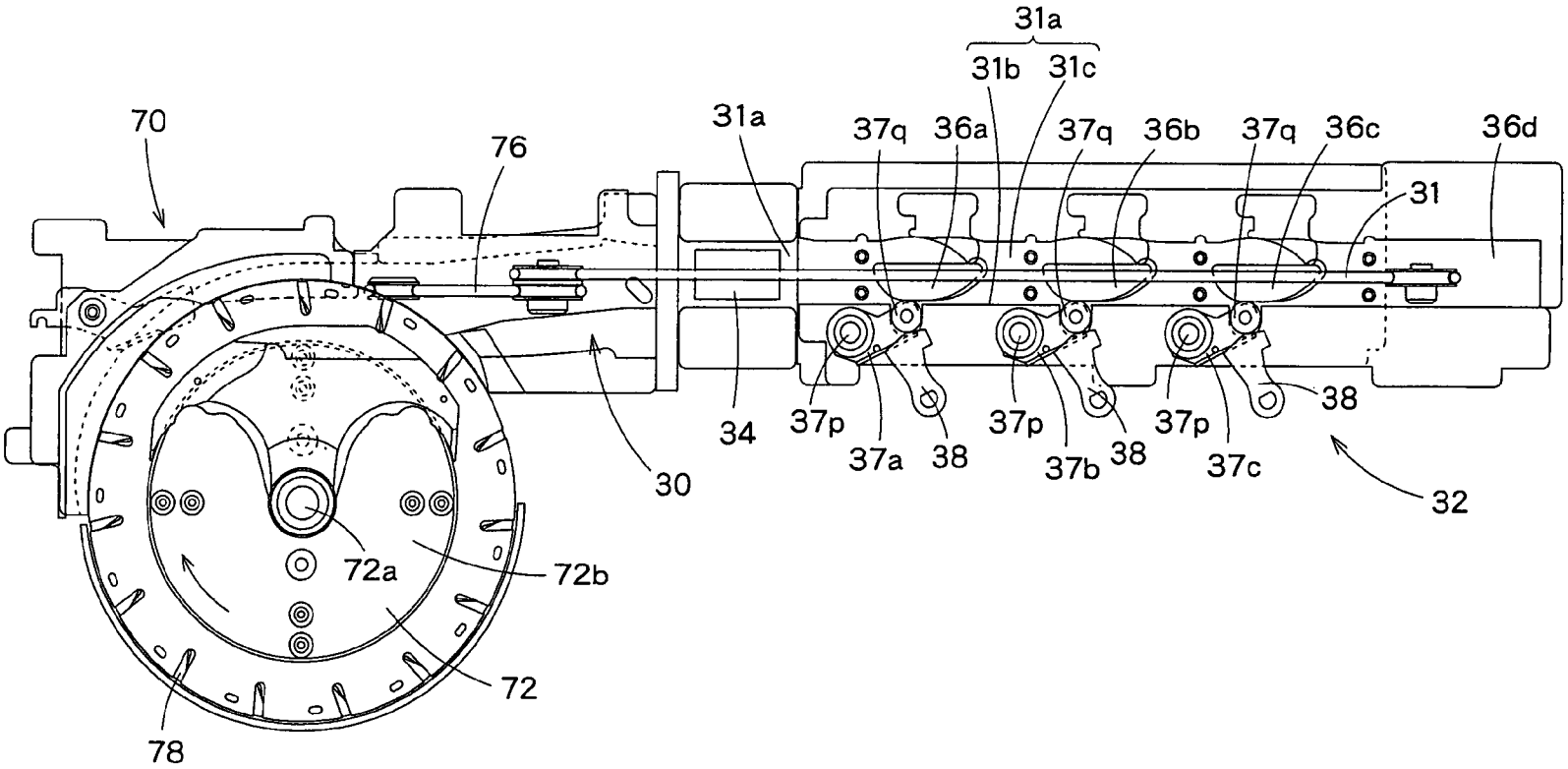
FIG. 2 is a structural view showing details of structures of a coin feeding unit, a transport unit and a sort unit in the coin handling machine shown in FIG. 1.
Figure 3:
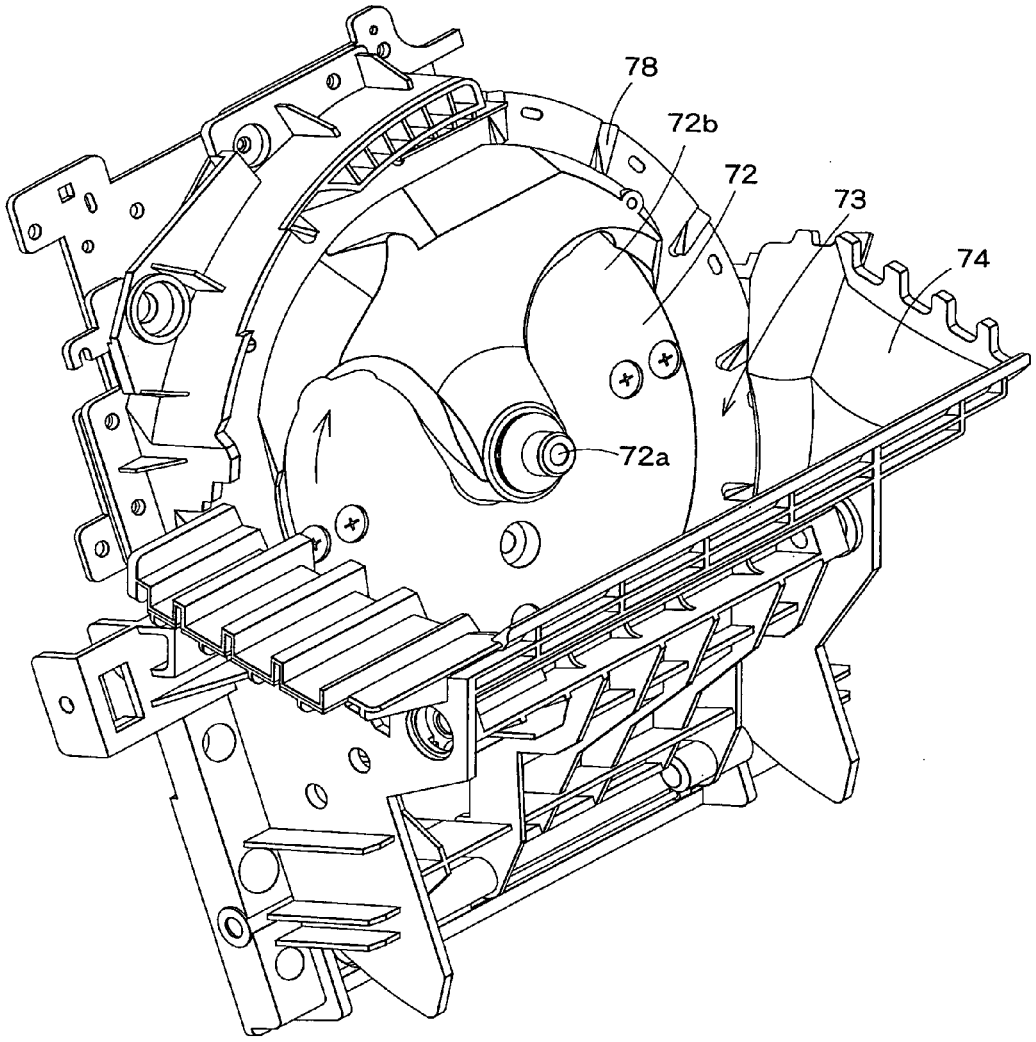
FIG. 3 is a perspective view showing details of a structure of the coin feeding unit in the coin handling machine shown in FIG. 1.
Figure 4A:
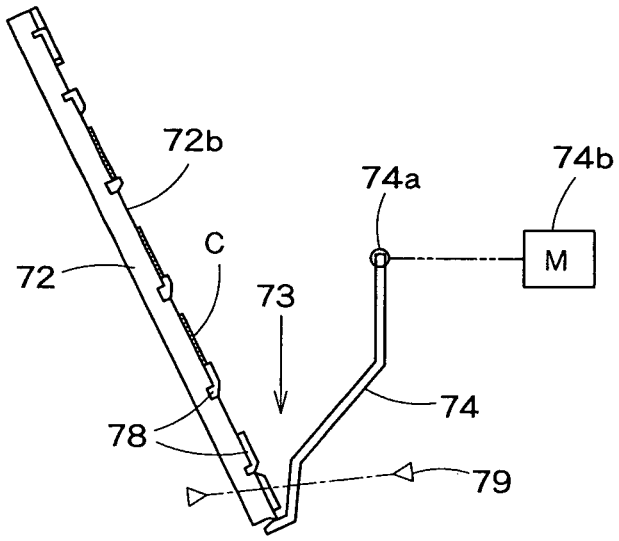
FIG. 4A is a side view of the coin feeding unit shown in FIG. 3, in which a hopper member is closed so that a coin storage space is defined between the hopper member and a surface of a rotary disc.
Figure 4B:
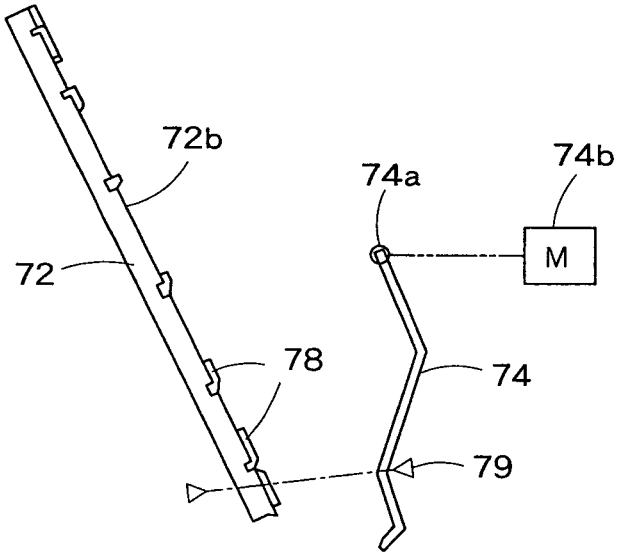
FIG. 4B is a side view of the coin feeding unit shown in FIG. 3, in which the hopper member is opened.

An embodiment of the present invention will be described herebelow with reference to the drawings. FIGS. 1 to 11 show a coin handling machine in this embodiment. FIG. 1 is a structural view schematically showing an inner structure of the coin handling machine in this embodiment. FIG. 2 is a structural view showing details of structures of a coin feeding unit, a transport unit and a sort unit in the coin handling machine shown in FIG. 1. FIG. 3 is a perspective view showing details of a structure of the coin feeding unit in the coin handling machine shown in FIG. 1. FIG. 4A is a side view of the coin feeding unit shown in FIG. 3, in which a hopper member is closed so that a coin storage space is defined between the hopper member and a surface of a rotary disc. FIG. 4B is a side view of the coin feeding unit shown in FIG. 3, in which the hopper member is opened. FIGS. 5 to 11 are views showing details of the structure of the coin feeding unit.

As shown in FIG. 1, the coin handling machine 10 includes: a housing 12 of substantially a rectangular parallelepiped shape; an inlet 14 through which coin(s) is (are) put into the housing 12 from outside thereof; a supply unit 20 configured to supply the coin put into the inlet 14 to a coin feeding unit 70, which is described below; and the coin feeding unit 70 configured to store the coin supplied from the supply unit 20 and to feed the stored coin. Connected to the coin feeding unit 70 is a transport unit 30 configured to transport the coin fed from the coin feeding unit 70 inside the housing 12. The transport unit 30 is provided with a recognition unit 34 configured to recognize the denomination, the fitness and the authentication of the coin. A sort unit 32 is connected to a downstream side of the transport unit 30. Coins which have been transported by the transport unit 30 are sorted by denomination or in a state in which denominations are mixed, by the sort unit 32 based on the recognition result of the recognition unit 34.

As shown in FIG. 1, a reject coin chute 62 is connected to the sort unit 32. Thus, a coin that could not be recognized by the recognition unit 34 and a coin that was recognized as a not normal coin by the recognition unit 34 are sent as rejected coins to the reject coin chute 62 from an opening 36*a* (described below) of the sort unit 32. A reject unit 60, that is accessible from outside the housing 12, is disposed on a downstream end of the reject coin chute 62, whereby the rejected coins are sent from the reject coin chute 62 to the reject unit 60. Thus, an operator can take out the rejected coins from the reject unit 60. In addition, a foreign-material discharge chute 64 is disposed below the coin feeding unit 70, whereby a foreign material sent from the coin feeding unit 70 to the foreign-material discharge chute 64 is sent to the reject coin chute 62.

An escrow unit 40 is disposed below the sort unit 32. The escrow unit 40 is composed of a plurality of (e.g., three)

escrow portions 40*a*, 40*b* and 40*c* that temporarily hold coins by denomination or in a state in which denominations are mixed. The coins sorted by the sort unit 32 are sent to the escrow portions 40*a*, 40*b* and 40*c* through chutes 32*a*, 32*b* and 32*c* corresponding to the escrow portions 40*a*, 40*b* and 40*c*. A storing unit 50 is further disposed below the escrow unit 40. The storing unit 50 is composed of a plurality of (e.g., three) storing portions 50*a*, 50*b* and 50*c* that store coins by denomination or in a state in which denominations are mixed. The coins temporarily held in the escrow portions 40*a*, 40*b* and 40*c* are sent to the storing portions 50*a*, 50*b* and 50*c* through chutes 42*a*, 42*b* and 42*c* corresponding to the storing portions 50*a*, 50*b* and 50*c*.

As shown in FIG. 1, the supply unit 20, the coin feeding unit 70, the transport unit 30, the sort unit 32, the recognition unit 34, the escrow unit 40, the storing unit 50 and so on are accommodated in the housing 12. By opening a door 12*a* of the housing 12 of the coin handling machine 10, coins stored in the storing unit 50 can be collected by a specified collector, such as a staff of an armored car company who is in charge of collecting cash, or a bank clerk.

In addition, the coin handling machine 10 is equipped with a control unit 16 configured to control the respective constituent elements of the coin handling machine 10. To be specific, the control unit 16 is configured to control the supply unit 20, the coin feeding unit 70, the sort unit 32, and the escrow unit 40. Information relating to a recognition result of coins is sent from the recognition unit 34 to the control unit 16.

Herebelow, details of the respective constituent elements of the coin handling machine 10 will be described.

As shown in FIG. 1, the supply unit 20 is located on a position directly below the inlet 14, so as to receive a plurality of coins in a state in which denominations are mixed, which are put into the inlet 14 by an operator. The coins received by the supply unit 20 are sent to the coin feeding unit 70 located on a position directly below the supply unit 20.

As shown in FIGS. 1 to 4, the coin feeding unit 70 includes a rotary disc 72 that is inclined at a predetermined angle with respect to the vertical direction, and a hopper member 74 that defines a coin storage space 73 for storing coins between the hopper member 74 and a surface 72*b* of the rotary disc 72. As shown in FIGS. 2 and 3, the rotary disc 72 is provided with a rotary shaft 72*a*, whereby the rotary disc 72 is rotated, while being inclined at a predetermined angle with respect to the vertical direction, by the rotary shaft 72*a* in directions shown by the arrows in FIGS. 2 and 3. In addition, the surface 72*b* of the rotary disc 72 on the side of the coin storage space 73 (the surface on the right side in FIGS. 4A and 4B) is provided with a plurality of protruding members 78. These protruding members 78 are arranged at equal intervals therebetween on positions near to and along an edge of the rotary disc 72. As shown in FIG. 4A and the like, the respective protruding members 78 catch coins (depicted by the reference number C in FIG. 4A) on the surface 72*b* of the rotary disc 72, so that the coins in a lower area of the rotary disc 72 are transported to an upper area of the rotary disc 72 along with the rotation of the rotary disc 72.

As shown in FIG. 2, in the coin feeding unit 70, a coin transport mechanism formed of, e.g., a transport belt 76, is disposed in the upper area of the rotary disc 72. The transport belt 76 of the coin transport mechanism is configured to transport coins, which have been transported by the protruding members 78 from the lower area of the rotary disc 72 to the upper area thereof, to an outside of the coin storage space 73. Specifically, coins are sent by the transport belt 76 from the coin storage space 73 to the transport unit 30.

As shown in FIGS. 4A and 4B, the hopper member 74 can be opened and closed. FIG. 4A is a side view of the coin feeding unit 70 shown in FIG. 3, in which the hopper member 74 is closed so that the coin storage space 73 is defined between the hopper member 74 and the surface of the rotary disc 72. FIG. 4B is a side view of the coin feeding unit 70 shown in FIG. 3, in which the hopper member 74 is opened. As shown in FIGS. 4A and 4B, the hopper member 74 is rotated about a shaft 74*a*. The shaft 74*a* is provided with a drive motor 74*b* that rotates the shaft 74*a* in a normal direction and a reverse direction. Due to the rotation of the shaft 74*a* by the drive motor 74*b*, the hopper member 74 is reciprocated between a closed position, which is shown in FIG. 4A, and an opened position, which is shown in FIG. 4B. The drive motor 74*b* is controlled by the control unit 16. Thus, the opening and closing operation of the hopper member 74 can be controlled by the control unit 16.

When the hopper member 74 is located on the closed position as shown in FIG. 4A, the coin storage space 73 is defined between the hopper member 74 and the surface of the rotary disc 72, whereby a plurality of coins in a state in which denominations are mixed are stored in the coin storage space 73. On the other hand, when the hopper member 74 is moved from the closed position which is shown in FIG. 4A, to the opened position which is shown in FIG. 4B, various objects including coins fall down from the coin storage space 73 so as to be sent to the foreign-material discharge chute 64. The objects, which have been sent from the coin feeding unit 70 to the foreign-material discharge chute 64, are sent to the reject coin chute 62.

The coin feeding unit 70 has a photosensor 79 that detects the presence of an object in the coin storage space 73. The photosensor 79 is composed of a light emitting element and a light receiving element, whereby light emitted from the light emitting element is received by the light receiving element. When an object exists in the coin storage space 73, the light emitted from the light emitting element is interfered with by the object, so that the light cannot reach the light receiving element. Thus, the photosensor 79 detects the presence of the object in the coin storage space 73.

When the photosensor 79 detects that an object remains in the coin storage space 73 after the operation for feeding the coins in the coin storage space 73 to the outside of the coin storage space 73 has been finished, the control unit 16 performs a control such that the hopper member 74 is opened by the drive motor 74*b* so that the object remaining in the coin storage space 73 falls down from the coin storage space 73. The object falling down from the coin storage space 73 is sent to the foreign-material discharge chute 64.

The more detailed structure of the aforementioned coin feeding unit 70 will be described hereafter.

The transport unit 30 has, e.g., a transport belt 31. Coins are transported one by one along a transport path 31*a* that extends substantially horizontally. The transport path 31*a* is composed of a transport-path bottom surface 31*b* and a transport-path side surface 31*c*. The transport-path side surface 31*c* is inclined at a predetermined angle with respect to the vertical direction. As shown in FIG. 2, in the transport path 31*a*, coins are transported in the right direction in FIG. 2 by the transport belt 31 along the transport-path side surface 31*c*, such that the coins are in contact with the transport-path bottom surface 31*b* by their own weights.

The recognition unit 34 is disposed on the transport unit 30, so as to recognize the denomination, the fitness and the authentication of the coins transported by the transport unit 30. Information relating to a recognition result of the coins by the recognition unit 34 is sent to the control unit 16.

The coins which have been recognized by the recognition unit 34 are sent to the sort unit 32, and the sort unit 32 then sorts the coins. To be specific, the transport-path side surface 31*c* of the transport path 31*a* in the sort unit 32 has a plurality of (e.g., three) openings 36*a*, 36*b* and 36*c*. The respective openings 36*a*, 36*b* and 36*c* communicate with the reject coin chute 62 and the chutes 32*a* and 32*b*. When coins transported along the transport-path side surface 31*c* in the transport path 31*a* enter the respective openings 36*a*, 36*b* and 36*c*, the coins are sent to the reject coin chute 62 and the chutes 32*a* and 32*b*, respectively. In addition, in the downstream end of the transport path 31*a*, an opening 36*d* is formed on the downstream side of the openings 36*a*, 36*b* and 36*c*. The opening 36*d* is in communication with the chute 32*c*. When the coins transported by the transport path 31*a* do not enter the respective openings 36*a*, 36*b* and 36*c*, the coins are transported by the transport belt 31 up to the downstream end of the transport path 31*a* so as to enter the opening 36*d*. The coins having entered the openings 36*d* are sent to the chute 32*c*.

In addition, correspondingly to the respective openings 36*a*, 36*b* and 36*c*, a plurality of (e.g., three) diverting members 37*a*, 37*b* and 37*c* are provided. The respective diverting members 37*a*, 37*b* and 37*c* are swingable about shafts 37*p* disposed below the transport-path bottom surface 31*b*. Rollers 37*q* are mounted on distal ends of the diverting members 37*a*, 37*b* and 37*c*. As shown in FIG. 2, correspondingly to the respective diverting members 37*a*, 37*b* and 37*c*, pushing members 38 that push upward the diverting members 37*a*, 37*b* and 37*c* are disposed below the respective diverting members 37*a*, 37*b* and 37*c*.

When the pushing members 38 do not push upward the respective diverting members 37*a*, 37*b* and 37*c*, the rollers 37*q* of the respective diverting members 37*a*, 37*b* and 37*c* do not project upward from the transport-path bottom surface 31*b* of the transport path 31*a*, whereby coins transported by the transport path 31*a* are not pushed upward by the rollers 37*q* of the respective diverting members 37*a*, 37*b* and 37*c*, from the transport-path bottom surface 31*b*. Thus, the coins transported by the transport path 31*a* do not enter the respective openings 36*a*, 36*b* and 36*c*, so that the coins are transported to the downstream end of the transport path 31*a* and enters the opening 36*d*.

On the other hand, when the pushing member 38 of the respective pushing members 38, which corresponds to the diverting member 37*a*, for example, pushes upward the diverting member 37*a*, the diverting member 37*a* is rotated upward about the shaft 37*p*, so that the roller 37*q* mounted on the distal end of the diverting member 37*a* projects upward from the transport-path bottom surface 31*b*. Thus, a coin transported by the transport path 31*a* is brought up by the roller 37*q* of the diverting member 37*a* and enters the opening 36*a*.

The pushing members 38 are respectively controlled by the control unit 16. To be specific, when a coin that could not be recognized by the recognition unit 34 or a coin that was recognized as an abnormal coin by the recognition unit 34 is sent to the sort unit 32, the control unit 16 controls the pushing member 38 corresponding to the diverting member 37*a* such that the diverting member 37*a* is pushed upward by the pushing member 38. Thus, the coin is made to enter the opening 36*a* and is set to the reject coin chute 62. The coin is finally sent from the reject coin chute 62 to the reject unit 60. On the other hand, when the denominations of coins were recognized by the recognition unit 34, the control unit 16 controls the respective pushing members 38 corresponding to the diverting members 37*b* and 37*c*, such that the coins are made to enter the openings 36*b*, 36*c* and 36*d* by denomination. After the coins have been made to enter the openings 36*b*, 36*c* and 36*d* by the denominations, the coins having entered the respective openings 36*b*, 36*c* and 36*d* are sent to the respective escrow portions 40*a*, 40*b* and 40*c* of the escrow unit 40 through the chutes 32*a*, 32*b* and 32*c*, respectively. Alternatively, coins in a state in which denominations are mixed are sequentially sorted by the opening 36*b*, and are temporarily held in the escrow portion 40*a* through the chute 32*a*. After the predetermined number of coins are stored in the escrow portion 40*a* so that the escrow portion 40*a* becomes full, coins are then sorted by the next opening 36*c* and are continuously processed.

The respective escrow units 40*a*, 40*b* and 40*c* of the escrow unit 40 are configured to temporarily hold coins by denomination or in a state in which denominations are mixed. The coins temporarily held in the respective escrow portions 40*a*, 40*b* and 40*c* are finally sent to the respective storing portions 50*a*, 50*b* and 50*c* of the storing unit 50, through the chutes 42*a*, 42*b* and 42*c* below the escrow portions 40*a*, 40*b* and 40*c*, respectively. The storing portions 50*a*, 50*b* and 50*c* of the storing unit 50 are configured to store coins by denomination or in a state in which denominations are mixed. As described above, by opening a door 12*a* of the housing 12, the coins stored in the respective storing portions 50*a*, 50*b* and 50*c* of the storing unit 50 can be collected by a specified collector, such as a staff of an armored car company who is in charge of collecting cash, or a bank clerk.

Figure 5:
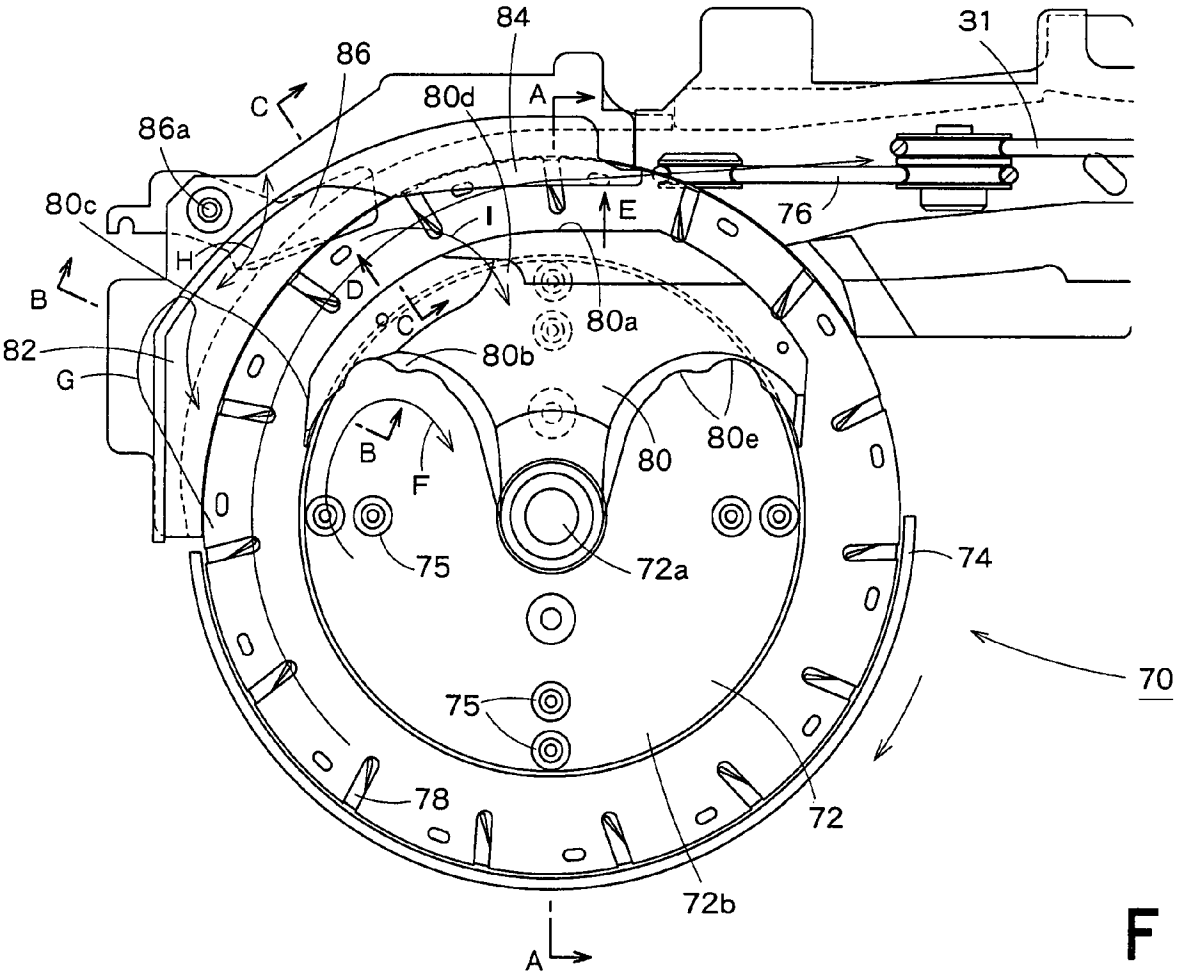
FIG. 5 is a front view of the coin feeding unit shown in FIG. 3.
Figure 6:
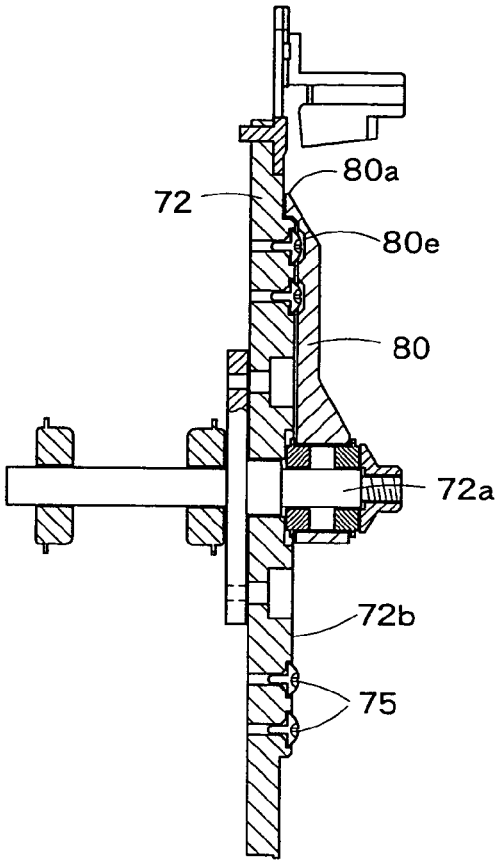
FIG. 6 is a sectional view of the coin feeding unit shown in FIG. 5 taken along the arrows A-A, showing a structure of a first guide member.
Figure 7A:
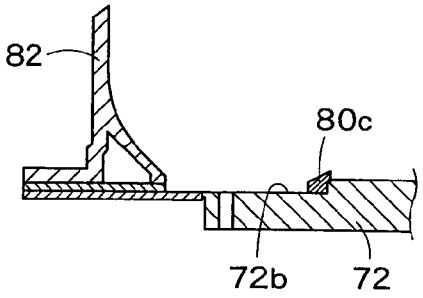
FIG. 7A is a sectional view of the coin feeding unit shown in FIG. 5 taken along the arrows B-B, showing a structure of a second guide member.
Figure 7B:
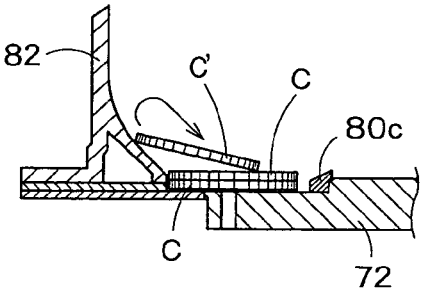
FIG. 7B is a view showing that three superposed coins are transported by one protruding member in the second guide member shown in FIG. 7A.
Figure 8:
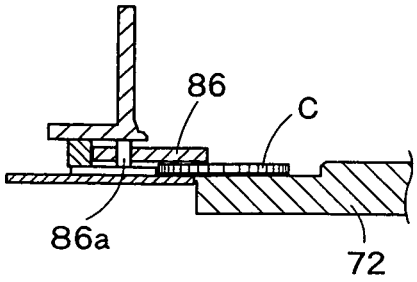
FIG. 8 is a sectional view of the coin feeding unit shown in FIG. 5 taken along the arrows C-C, showing a structure of a lever member.
Figure 9:
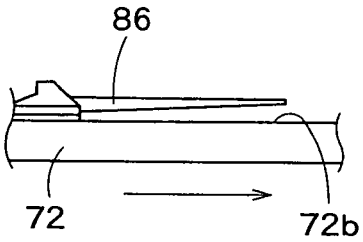
FIG. 9 is a view showing the structure of the lever member when the coin feeding unit shown in FIG. 5 is viewed from the D direction.
Figure 10:
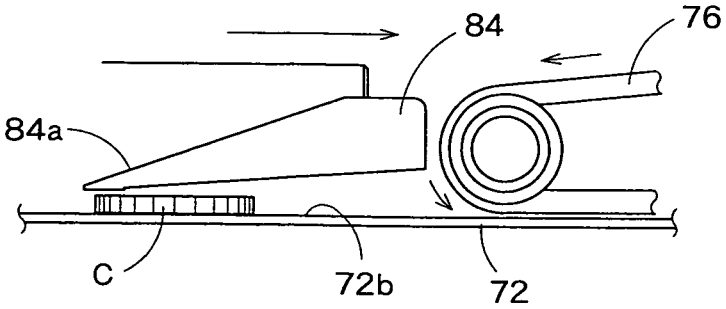
FIG. 10 is a view showing a structure of the second guide member, when the coin feeding unit shown in FIG. 5 is viewed from the E direction.
Figure 11:
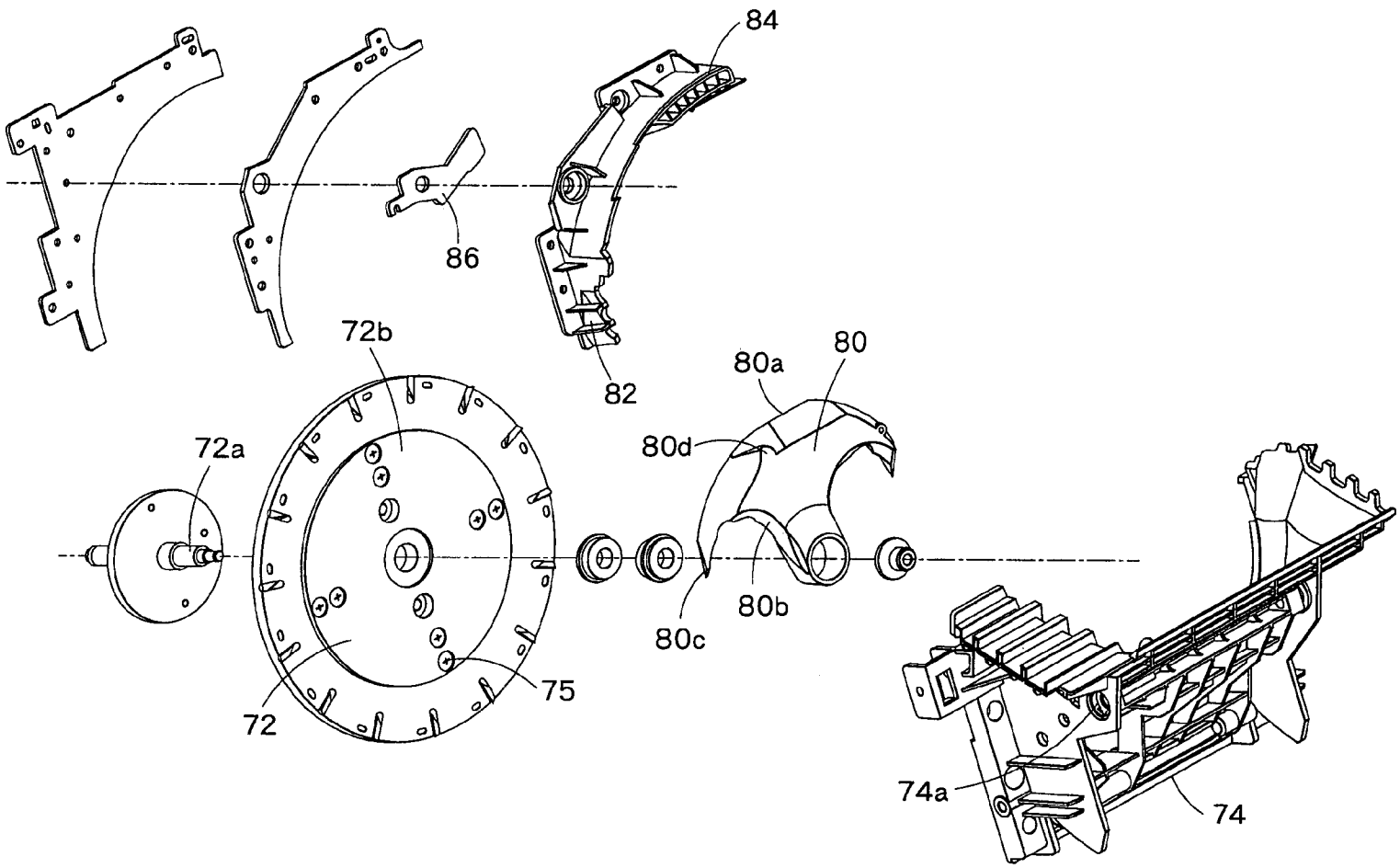
FIG. 11 is an exploded perspective view of the coin feeding unit shown in FIG. 5.
Figure 12:
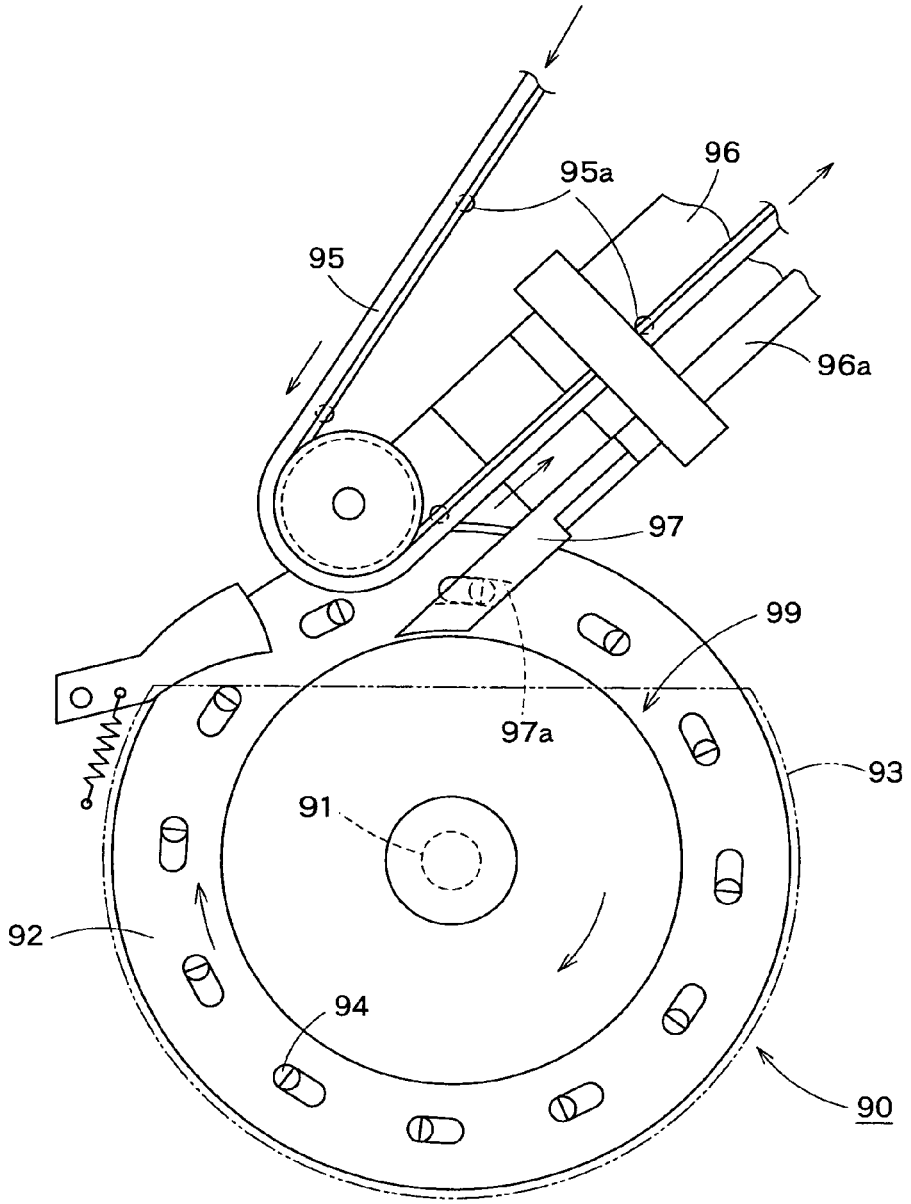
FIG. 12 is a front view showing a structure of a conventional coin feeding device.

Next, further details of the coin feeding unit 70 in this embodiment are described with reference to FIGS. 5 to 11. FIG. 5 is a front view of the coin feeding unit 70 shown in FIG. 3. FIG. 6 is a sectional view of the coin feeding unit 70 shown in FIG. 5 taken along the arrows A-A, showing a structure of a first guide member 80. FIG. 7A is a sectional view of the coin feeding unit 70 shown in FIG. 5 taken along the arrows B-B, showing a structure of a second guide member 82. FIG. 7B is a view showing that three superposed coins are transported by the one protruding member 78 in the second guide member 82 shown in FIG. 7A. FIG. 8 is a sectional view of the coin feeding unit 70 shown in FIG. 5 taken along the arrows C-C, showing a structure of a lever member 86. FIG. 9 is a view showing the structure of the lever member 86 when the coin feeding unit 70 shown in FIG. 5 is viewed from the D direction. FIG. 10 is a view showing a structure of a third guide member 84, when the coin feeding unit 70 shown in FIG. 5 is viewed from the E direction. FIG. 11 is an exploded perspective view of the coin feeding unit 70 shown in FIG. 5.

As shown in FIG. 5 and so on, the coin feeding unit 70 is equipped with the first guide member 80, the second guide member 82, the third guide member 84, and the lever member 86.

The first guide member 80 is stationarily provided, and is located so as to cover the upper area of the rotary disc 72. To be more specific, the first guide member 80 is located nearer to the center of the rotary disk 72 than the respective protruding members 78 on the rotary disc 72, with a slight gap being defined between the first guide member 80 and the surface 72*b* of the rotary disc 72 on the side of the coin storage space 73. The first guide member 80 is connected to the rotary shaft 72*a* of the rotary disc 72 through a bearing.

The first guide member 80 is configured to guide, in the upper area of the rotary disc 72, coins transported by the respective protruding members 78 to the transport belt 76. More specifically, the first guide member 80 has a top surface portion 80*a*. The top surface portion 80*a* guides the coins, which have been transported by the respective protruding members 78 along with the rotation of the rotary disc 72, in substantially the horizontal direction (right direction in FIG.

5), in the upper area of the rotary disc 72. The top surface portion 80*a* extends along the substantially horizontal direction (right and left direction in FIG. 5). Since the first guide member 80 has the top surface portion 80*a*, the coins, which have been transported by the respective protruding members 78 to the upper area of the rotary disc 72, are moved on the top surface portion 80*a* of the first guide member 80 in substantially the horizontal direction (right direction in FIG. 5) so as to reach the transport belt 76.

As shown in FIG. 5 and so on, in the left area in FIG. 5, the first guide member 80 has a shuffling portion 80*b*. The shuffling portion 80*b* of the first guide member 80 is configured to shuffle the coins in the coin storage space 73, the coin having been disengaged from the protruding member 78 in the course of being transported from the lower area of the rotary disc 72 to the upper area thereof. To be specific, the shuffling portion 80*b* is inclined upward in FIG. 5 from the surface of the rotary disc 72 toward the viewer from the sheet of FIG. 5. As shown by the arrow F in FIG. 5, a coin, which has been disengaged from the protruding member 78 in the course of being transported from the lower area of the rotary disc 72 to the upper area thereof, collides with the shuffling member 80*b* so as to be returned to the lower area of the rotary disc 72. Namely, since the first guide member 80 has the shuffling portion 80*b*, the coin can be shuffled in the coin storage space 73 as shown by the arrow F of FIG. 5.

As shown in FIGS. 5 and 11, in the left area in FIG. 5, the first guide member 80 has a guide wall portion 80*c*. The guide wall portion 80*c* extends in the up and down direction in FIG. 5 at a position that is substantially the same level as the center of the rotary disc 72. The guide wall portion 80*c* is configured to guide coins, which have been transported by the respective protruding members 78 from the lower area of the rotary disc 72, in a direction perpendicular to the horizontal direction (i.e., upward direction in FIG. 5) along the surface of the rotary disc 72, at the position that is substantially the same level as the center of the rotary disc 72. Since such a guide wall portion 80*c* is provided on the first guide member 80, the coins, which have been transported by the respective protruding members 78 from the lower area of the rotary disc 72, are transported upward at the position that is substantially the same level as the center of the rotary disc 72, without being disengaged from the respective protruding members 78 toward the center of the rotary disc 72.

As shown in FIGS. 5 and 11, in the vicinity of a location of the lever member 86 (described below), the first guide member 80 has a projecting portion 80*d* that projects away from the surface of the rotary disc 72 (i.e., that projects toward the viewer from the sheet of FIG. 5). As shown by the arrow I in FIG. 5, a coin, which has been disengaged from the protruding member 78 by the lever member 86, falls down by its own weight to the lower area of the rotary disc 72. The operation of the coin on the surface of the rotary disc 72, which is disengaged from the protruding member 78 by the lever member 86, is described below. Since such a projecting portion 80*d* is provided on the first guide member 80, the coin, which has been disengaged from the protruding member 78 by the lever member 86, can be smoothly made to fall down to the lower area of the rotary disc 72, whereby the shuffling of coins by the first guide member 80 in the coin storage space 73 can be further promoted.

As shown in FIGS. 5, 7A and 7B, the second guide member 82 is stationarily provided, and is located radially outward from the rotary disc 72 on a position that is upper than the center of the rotary disc 72. Specifically, as shown in FIG. 7A and so on, the second guide member 82 is inclined from the surface 72*b* of the rotary disc 72 radially outward from the rotary disc 72. As shown in FIG. 7B, when three or more coins C in a superposed state are transported by the one protruding member 78 from the lower area of the rotary disc 72, the second guide member 82 is configured to guide the coin C' which lies upon the two superposed coins C on the rotary disc 72 radially outward from the rotary disc 72 (left direction in FIG. 7B) by the centrifugal force of the rotary disc 72. The coin C', which has been guided radially outward from the rotary disc 72 by the centrifugal force of the rotary disc 72, is disengaged from the protruding member 78 so as to be returned to the lower area of the rotary disc 72 by its own weight, as shown by the arrow G in FIG. 5. Since such a second guide member 82 is provided, when three or more coins in a superposed state are transported by the one protruding member 78 from the lower area of the rotary disc 72, the coin(s) lying upon the two superposed coins on the rotary disc 72 can be returned to the lower area of the rotary disc 72 by its (their) own weight(s).

The structure of the second guide member 82 is not limited to the structure shown in FIGS. 7A and 7B. The following structure is possible as another embodiment of the second guide member. Namely, when two or more coins in a superposed state are transported by the one protruding member 78 from the lower area of the rotary disc 72, the coin(s) lying upon the coin on the rotary disc 72, i.e., the second coin, the third coin . . . may be guided radially outward from the rotary disc 72 (left direction in FIG. 7B) by the centrifugal force of the rotary disc 72. With the use of such a second guide member, when two or more coins in a superposed state are transported by the one protruding member 78 from the lower area of the rotary disc 72, the coin(s) lying upon the coin in contact with the rotary disc 72 can be returned to the lower area of the rotary disc 72 by its (their) own weight(s).

As shown in FIGS. 5 and 10, the third guide member 84 is stationarily provided, and is located in the upper area of the rotary disc 72. The third guide member 84 is disposed such that a gap through which one normal coin can pass is defined between the third guide member 84 and the surface 72*b* of the rotary disc 72 on the side of the coin storage space 73. Since such a third guide member 84 is provided, two or more coins in a superposed state can be restrained from being sent from the upper area of the rotary disc 72 to the transport belt 76.

As shown in FIG. 10, the third guide member 84 is structured such that the distance between the third guide member 84 and the surface 72*b* of the rotary disc 72 on the side of the coin storage space 73 is gradually increased along the coin transport direction (direction shown by the arrow in FIG. 10) along the edge of the rotary disc 72. Thus, two superposed coins and/or a foreign material such as a deformed coin can be restrained from being sandwiched between the rotary disc 72 and the third guide member 84.

As shown in FIG. 10, the third guide member 84 has an inclined portion 84*a*. The inclined portion 84*a* is inclined so as to be away from the surface of the rotary disc 72 along the coin transport direction along the edge of the rotary disc 72 (direction shown by the arrow in FIG. 10) (i.e., the inclined portion 84*a* is inclined to project toward the viewer from the sheet of FIG. 5). The inclined portion 84*a* of the third guide member 84 is configured to separate a coin lying upon a coin on the rotary disc 72 away from the rotary disc 72. The coin that has been separated away from the rotary disc 72 is retuned to the lower area of the rotary disc 72 by its own weight. Since the third member 84 has the inclined portion 84*a*, two or more coins in a superposed state can be further restrained from being sent to the transport belt 76.

As shown in FIGS. 5, 8 and 9, the lever member 86 is disposed in the vicinity of the edge of the rotary disc 72 in the upper area of the rotary disc 72. The lever member 86 has a shaft 86*a* that is disposed radially outward from the rotary disc 72. The lever member 86 is swingable about the shaft 86*a* in the direction shown by the arrow H in FIG. 5 along the surface 72*b* of the rotary disc 72 on the side of the coin storage space 73. As shown in FIG. 8, the lever member 86 is located such that a gap through which one normal coin C can pass is defined between the lever member 86 and the surface 72*b* of the rotary disc 72 on the side of the coin storage space 73. Since such a lever member 86 is provided, two or more coins in a superposed state can be restrained from being sent from the lower area of the rotary disc 72 to the upper area thereof.

As shown in FIG. 9, the lever member 86 is structured such that the distance between the lever member 86 and the surface 72*b* of the rotary disc 72 on the side of the coin storage space 73 is gradually increased along the coin transport direction (direction shown by the arrow in FIG. 9) along the edge of the rotary disc 72. Thus, two superposed coins and/or a foreign material such as a deformed coin can be restrained from being sandwiched between the rotary disc 72 and the lever member 86.

As shown in FIGS. 5 and 6, the surface 72*b* of the rotary disc 72 is provided with a plurality of protrusions 75. The respective protrusions 75 are located nearer to the center of the rotary disc 72 than the respective protruding members 78 on the surface 72*b* of the rotary disc 72. The respective protrusions 75 are disposed on the surface 72*b* of the rotary disc 72 so as to shuffle coins in the coin storage space 73. To be specific, when the rotary disk 72 is rotated, the coins are shuffled by the respective protrusions 75 in the coin storage space 73.

As shown in FIGS. 5 and 6, the first guide member 80 has hollows 80*e* that allow passage of the respective protrusions 75 disposed on the surface 72*b* of the rotary disc 72 when the rotary disc 72 is rotated. Since such hollows 80*e* are provided in the first guide member 80, the respective protrusions 75 do not collide with the first guide member 80 when the rotary disc 72 is rotated.

Next, an operation of the coin handling machine 10 as structured above will be described below. The below-described operation of the coin handling machine 10 is performed by the control unit 16 that controls the respective constituent elements of the coin handling machine 10.

When an operator puts one or a plurality of coins into the inlet 14 of the coin handling machine 10, the coin(s) is(are) sent to the supply unit 20. Then, the predetermined number of coins or all the coins in the supply unit 20 are sent from the supply unit 20 to the coin feeding unit 70, and the coins sent to the coin feeding unit 70 are stored in the coin storage space 73.

When the rotary disc 72 of the coin feeding unit 70 is rotated in the direction shown by the arrow in FIG. 2 or 5, the coins stored in the coin storage space 73 and thus positioned in the lower area of the rotary disc 72 are caught by the respective protruding members 78 on the surface 72*b* of the rotary disc 72. The coins caught by the respective protruding members 78 on the surface 72*b* of the rotary disc 72 are transported from the lower area of the rotary disc 72 to the upper area thereof. Then, in the upper area of the rotary disc 72, the coins are guided one by one by the first guide member 80 to the transport belt 76. To be specific, the coins caught by the respective protruding members 78 on the surface 72*b* of the rotary disc 72 are transported to the upper area of the rotary disc 72 via the second guide member 82, the lever member 86, and the third guide member 84, in this order. Then, the coins which have been transported to the upper area of the rotary disc 72 are guided one by one by the first guide member 80 to the transport belt 76. The coins having been sent to the transport belt 76 are transported one by one by the transport belt 76 to the outside of the coin storage space 73. More specifically, as shown in FIG. 2, the coins transported by the transport belt 76 are delivered to the transport belt 31 of the transport unit 30, and the coins are transported one by one by the transport belt 31 in the right direction in FIG. 2.

When the coins are transported by the transport belt 31, the denomination and so on of the coins are recognized by the recognition unit 34. The coins recognized by the recognition unit 34 are sent to the sort unit 32. In the sort unit 32, a coin that could not be recognized by the recognition unit 34 or a coin that was recognized as an abnormal coin by the recognition unit 32 is made to enter the opening 36*a*, by the control unit 16 that controls the pushing member 38 corresponding to the diverting member 37*a*. The coin having entered the opening 36*a* is sent to the reject unit 60 through the reject coin chute 62, whereby the operator can take out the coin sent to the reject unit 60. On the other hand, coins that have been recognized as normal coins by the recognition unit 34 are made to enter one of the respective openings 36*b*, 36*c* and 36*d* by denomination, by the control unit 16 that controls the pushing members 38 corresponding to the diverting members 37*b* and 37*c*. The coins having entered the respective openings 36*b*, 36*c* and 36*d* are respectively sent through the chutes 32*a*, 32*b* and 32*c* to the escrow portions 40*a*, 40*b* and 40*c* of the escrow unit 40 by the denomination, and are temporarily held in the escrow portions 40*a*, 40*b* and 40*c*. Alternatively, the coins in a state in which denominations are mixed are sequentially sorted by the opening 36*b*, and are temporarily held in the escrow portion 30*a* through the chute 32*a*. After the predetermined number of coins are stored so that the escrow portion 40*a* becomes full, coins are then sorted by the next opening 36*c* and are continuously processed. Thereafter, the coins which have been temporarily held in the escrow portions 40*a*, 40*b* and 40*c* are respectively sent through the chutes 42*a*, 42*b* and 42*c* to the storing portions 50*a*, 50*b* and 50*c* of the storing unit 50 by denomination or in a state in which denominations are mixed, so as to be stored in the storing portions 50*a*, 50*b* and 50*c*.

After the feeding operation of the coins in the coin storage space 73 in the coin feeding unit 70 has been finished, the photosensor 79 detects whether there is any remaining object (e.g., a deformed coin and an object other than a coin) in the coin storage space 73. When the photosensor 79 detects that an object remains in the coin storage space 73, the drive motor 74*b* opens the hopper member 74, as shown in FIG. 4B, so that the object remaining in the coin storage space 73 falls down from the coin storage space 73. The object having fallen down from the coin storage space 73 is sent to the reject unit 60 through the foreign-material discharge chute 64.

In this manner, a series of coin processing operations in the coin handling machine 10 is completed.

According to the coin feeding unit (coin feeding device) 70 in this embodiment and the coin handling machine 10 including the coin feeding unit 70, the first guide member 80, which is configured to guide, in the upper area of the rotary disc 72, coins which have been transported by the respective protruding members 78 to the transport belt (coin transport mechanism) 76, is stationarily provided on a position that is nearer to the center of the rotary disc 72 than the respective protruding members 78 of the rotary disc 72. Thus, even when the rotary disc 72 is rotated at a high speed, there is no possibility that the coins transported in the upper area of the rotary disc 72 by the respective protruding members 78 might be sandwiched between the rotary disc 72 and the first guide member 80, whereby the coins can be stably sent one by one from the rotary disc 72 to the transport belt 76. Thus, the normal coins can be stably fed one by one from the coin storage space 73 to the outside thereof. As a result, a processing speed of coins of the coin feeding unit 70 can be increased as compared with that of the conventional money feeding unit.

In addition, in the coin feeding unit 70 in this embodiment, the second guide member 82 is stationarily provided, and is located radially outward from the rotary disc 72 on a position that is higher than the center of the rotary disc 72. To be specific, as shown in FIG. 7A and so on, the second guide member 82 is inclined from the surface 72*b* of the rotary member 72 radially outward from the rotary disc 72. When three or more coins C in a superposed state are transported by the one protruding member 78 from the lower area of the rotary disc 72, the second guide member 82 is configured to guide, as shown in FIG. 7B, the coin C' lying upon the other two superposed coins C on the rotary disc 72 radially outward from the rotary disc 72 (left direction in FIG. 7B) by the centrifugal force of the rotary disc 72. The coin C', which has been guided radially outward from the rotary disc 72 by the centrifugal force of the rotary disc 72, is disengaged from the protruding member 78 and is returned to the lower area of the rotary disc 72 by its own weight, as shown by the arrow G in FIG. 5. Since such a second guide member 82 is provided, when three or more coins in a superposed state are transported by the one protruding member 78 from the lower area of the rotary disc 72, the coin(s) lying upon the other two superposed coins on the rotary disc 72 can be returned to the lower area of the rotary disc 72 by its (their) own weight(s).

In addition, in the coin feeding unit 70 in this embodiment, the third guide member 84 is stationarily provided, and is located in the upper area of the rotary disc 72. The third guide member 84 is located such that a gap through which one normal coin can pass is defined between the third guide member 84 and the surface 72*b* of the rotary disc 72 on the side of the coin storage space 73. Since such a third guide member 84 is provided, two or more coins in a superposed state can be restrained from being sent from the upper area of the rotary disc 72 to the transport belt 76.

In addition, in the coin feeding unit 70 in this embodiment, the lever member 86 is disposed in the vicinity of the edge of the rotary disc 72 in the upper area of the rotary disc 72. The lever member 86 has the shaft 86*a* that is disposed radially outward from the rotary disc 72. The lever member 86 is swingable about the shaft 86*a* in the direction shown by the arrow H in FIG. 5 along the surface 72*b* of the rotary disc 72 on the side of the coin storage space 73. As shown in FIG. 8, the lever member 86 is disposed such that a gap through which one normal coin C can pass is defined between the lever member 86 and the surface 72*b* of the rotary disc 72 on the side of the coin storage space 73. Since such a lever member 86 is provided, two or more coins in a superposed state can be restrained from being sent from the lower area of the rotary disc 72 to the upper area thereof.

The coin feeding unit (coin feeding device) in this embodiment and the coin handling machine including the coin feeding unit are not limited to the above embodiment, but can be variously modified.

To be specific, in the coin feeding unit 70 shown in FIG. 5, for example, one or more of the second guide member 82, the third member 84 and the lever member 86 can be omitted. Further, the structure of the first guide member is not limited to the structure shown in FIG. 5. As long as the first guide member can guide, in the upper area of the rotary disc, coins transported by the respective protruding members, and as long as the first guide member is located nearer to the center of the rotary disc than the respective protruding members on the rotary disc, the first guide member of various shapes and various sizes can be used.

The invention claimed is:

1. A coin feeding device comprising:

a rotary disc that is inclined at a predetermined angle with respect to a vertical direction, the rotary disc being mounted on a rotary shaft by which the rotary disc is rotated while being inclined at the predetermined angle with respect to the vertical direction;

a hopper member configured to define a coin storage space for storing coins between the hopper member and a surface of the rotary disc;

a plurality of protruding members disposed on the surface of the rotary disc on a side of the coin storage space, the respective protruding members being located on positions near to an edge of the rotary disc so as to define a first circumference, and the respective protruding members being configured to catch coins on the surface of the rotary disc, so as to transport the coins from a lower area of the rotary disc to an upper area of the rotary disc along with a rotation of the rotary disc;

a coin transport mechanism disposed in the upper area of the rotary disc, the coin transport mechanism being configured to transport the coins, which have been transported by the respective protruding members to the upper area of the rotary disc, to an outside of the coin storage space; and a first guide member that is stationarily provided and located between the first circumference and a center of the rotary disc, with a slight gap being defined between the first guide member and the surface of the rotary disc on the side of the coin storage space, the first guide member being configured to guide, in the upper area of the rotary disc, the coins having been transported by the respective protruding members, to the coin transport mechanism, wherein the first guide member has a top surface portion configured to guide, in the upper area of the rotary disc, the coins, having been transported by the respective protruding members along with the rotation of the rotary disc, in a substantially horizontal direction so as to send the coins to the coin transport mechanism, and wherein the first guide member has a shuffling portion configured to shuffle the coins in the coin storage space, the coins having been disengaged from the protruding member in the course of being transported by the protruding member from the lower area of the rotary disc to the upper area thereof.

2. The coin feeding device according to claim 1, wherein the coins having been transported by the respective protruding members to the upper area of the rotary disc are moved on the top surface portion of the first guide member in substantially the horizontal direction so as to reach the coin transport mechanism.

3. The coin feeding device according to claim 1, wherein the first guide member has a guide wall portion configured to guide upward the coins, which have been transported by the respective protruding members from the lower area of the rotary disc, along the surface of the rotary disc at a position that is substantially the same level as the center of the rotary disc.

4. The coin feeding device according to claim 1, further comprising a second guide member that is stationarily provided, and is located radially outward from the rotary disc on a position that is higher than the center of the rotary disc, the second guide member being configured to guide, when two or more coins in a superposed state are transported by the one protruding member from the lower area of the rotary disc, the coin(s) lying upon the other coin(s) on the rotary disc radially outward from the rotary disc by the centrifugal force of the rotary disc.

5. The coin feeding device according to claim 4, wherein when three or more coins in a superposed state are transported by the one protruding member from the lower area of the rotary disc, the second guide member is configured to guide the coin(s) lying upon the other two superposed coins on the rotary disc radially outward from the rotary disc by the centrifugal force of the rotary disc.

6. The coin feeding device according to claim 1, further comprising a lever member that is disposed in the vicinity of the edge of the rotary disc, the lever member having a shaft that is disposed radially outward from the rotary disc, the lever member being swingable about the shaft along the surface of the rotary disc on the side of the coin storage space, and the lever member being located such that a gap through which one normal coin can pass is defined between the lever member and the surface of the rotary disc on the side of the coin storage space.

7. The coin feeding device according to claim 6, wherein the lever member is structured such that the distance between the lever member and the surface of the rotary disc on the side of the coin storage space is gradually increased along the coin transport direction along the edge of the rotary disc.

8. The coin feeding device according to claim 6, wherein in the vicinity of the location of the lever member, the first guide member has a projecting portion that projects away from the surface of the rotary disc, whereby a coin, which has been disengaged from the protruding member by the lever member, falls down along the projecting portion of the first guide member to the lower area of the rotary disc.

9. The coin feeding device according to claim 1, further comprising a third guide member that is stationarily provided, and is located in the upper area of the rotary disc, the third guide member being disposed such that a gap through which one normal coin can pass is defined between the third guide member and the surface of the rotary disc on the side of the coin storage space.

10. The coin feeding device according to claim 9, wherein the third guide member is structured such that the distance between the third guide member and the surface of the rotary disc on the side of the coin storage space is gradually increased along the coin transport direction along the edge of the rotary disc.

11. The coin feeding device according to claim 9, wherein the third guide member has an inclined portion that is inclined such that, when two or more coins in a superposed state are transported by the one protruding member to the third guide member, the coin(s) lying upon the other coin(s) on the rotary disc is (are) separated from the rotary disc.

12. The coin feeding device according to claim 1, wherein the surface of the rotary disc is provided with a shuffling protrusion configured to shuffle the coins in the coin storage space, when the rotary disc is rotated.

13. The coin feeding device of claim 1, further comprising:

a detecting unit configured to detect whether an object exists in the coin storage space or not;

a drive unit configured to openably and closably drive the hopper member; and a control unit configured to control the drive unit, such that, when the detecting unit detects that an object remains in the coin storage space after the operation for feeding coins in the coin storage space to the outside of the coin storage space has been finished, the drive unit opens the hopper member so that the object remaining in the coin storage space falls down from the coin storage space.

14. A coin handling machine comprising:

a housing;

a coin inlet through which coin(s) is (are) put from outside into the housing;

the coin feeding device according to claim 1, to which the coin put into the coin inlet is sent;

a recognition unit configured to recognize the coin transported by the coin transport mechanism of the coin feeding device; and a storing unit configured to store the coin transported by the coin transport mechanism.

* * * * *